US005996180A

United States Patent [19]

Eisenzopf

[11] Patent Number: 5,996,180

[45] Date of Patent: Dec. 7, 1999

[54] QUICK RELEASE HANDLE

[75] Inventor: Alex D. Eisenzopf, Gloucester, Mass.

[73] Assignee: Cyrk, Inc., Gloucester, Mass.

[21] Appl. No.: 09/070,906

[22] Filed: May 1, 1998

[51] Int. Cl.[6] ..... A45C 13/30

[52] U.S. Cl. ..... 16/406; 16/411; 16/428; 190/117; 150/107

[58] Field of Search ..... 16/406, 411, 425, 16/428; 294/171, 137; 190/117, 116; 150/107

[56] References Cited

U.S. PATENT DOCUMENTS

| | | | |
|---|---|---|---|
| 968,440 | 8/1910 | Allison | 16/411 |
| 1,020,722 | 3/1912 | Somerville | 16/406 |
| 2,319,147 | 5/1943 | Mason | 16/425 |
| 2,398,436 | 4/1946 | Mason | 16/425 |
| 2,518,006 | 8/1950 | Henriksen | 294/137 |
| 2,654,115 | 10/1953 | Kafer | 190/116 |
| 2,800,940 | 7/1957 | Riesebeck | 150/12 |
| 3,115,228 | 12/1963 | Louik et al. | 190/117 |
| 3,115,229 | 12/1963 | Erhard | 190/117 |
| 4,592,091 | 5/1986 | Italici | 383/15 |
| 4,679,671 | 7/1987 | Kobayashi | 190/115 |
| 5,115,894 | 5/1992 | Kuo | 190/117 |
| 5,210,904 | 5/1993 | Pratt | 16/111 |
| 5,279,443 | 1/1994 | Koda et al. | 220/755 |

*Primary Examiner*—Chuck Y. Mah
*Assistant Examiner*—Donald M. Gurley
*Attorney, Agent, or Firm*—Christie, Parker & Hale, LLP

[57] ABSTRACT

A handle assembly comprises two handle pieces. Each handle piece comprises a left section having left and right ends and inside and outside faces, a right section having left and right ends and inside and outside faces, and a center section containing a notch. The center section connects the right end of the left section to the left end of the right section in a generally diagonal manner. The handle pieces are capable of interlocking such that the center section of each handle piece fits into the notch of the other handle piece, the inside face of the left section of one handle piece is situated against the inside face of the left section of the other handle piece, and the inside face of the right section of one handle piece is situated against the inside face of the right section of the other handle piece. The handle assembly can be incorporated into a bag comprising two handle straps, each handle strap being associated with a different handle piece.

19 Claims, 5 Drawing Sheets

QUICK RELEASE HANDLE

BACKGROUND OF THE INVENTION

The present invention relates to a two-part interlocking handle assembly that enables the user to quickly attach or detach flexible handle straps, such as those common on soft-sided luggage and sport bags. The handle assembly provides strain relief while carrying the bag by distributing the load more evenly and comfortably across the fingers and palm of the hand. The handle assembly's quick detach feature provides easy access to the bag's main opening that is between the handle straps.

Previous interlocking handles have been designed, such as that described in U.S. Pat. No. 5,210,904 to Pratt. The Pratt handle, having a cradle design, involves two interlocking pieces where one piece fits almost entirely in a recessed channel in the second piece. Thus, to interlock the pieces of the Pratt handle when carrying a bag, a user must raise one piece above the other to get it into the recessed channel. Another disadvantage of the Pratt handle is that it requires two different molds to manufacture the two different-shaped handle pieces.

The present invention, in contrast, allows the user to interlock the pieces at the same height. Additionally, the handle pieces can be manufactured from the same mold, making the handle assembly more economical to produce.

SUMMARY OF THE INVENTION

The handle assembly of the present invention comprises two handle pieces. Each handle piece comprises a left section having left and right ends and inside and outside faces, a right section having left and right ends and inside and outside faces, and a center section containing a notch. The center section connects the right end of the left section to the left end of the right section in a generally diagonal manner. The handle pieces are capable of interlocking such that the center section of each handle piece fits into the notch of the other handle piece, the inside face of the left section of one handle piece is situated against the inside face of the left section of the other handle piece, and the inside face of the right section of one handle piece is situated against the inside face of the right section of the other handle piece. Preferably the cross-sectional shape of each handle piece is a "U" shape. The invention also relates to a handle assembly as described above where each handle piece further comprises a bore for receiving a handle strap, wherein the bore extends through the left, center and right sections of the handle piece.

The handle pieces of the inventive handle assembly interlock on different planes, the horizontal plane and the vertical plane. This design allows the user to more easily interlock the handle pieces at the same height, and does not require the user to lift one piece to fit into the other.

The present invention is also directed to a bag comprising two handle straps and a handle assembly as described above. Each handle strap is associated with a different handle piece. In a preferred embodiment, each handle piece contains a bore so that one handle strap extends through the bore in one of the handle pieces and the other handle strap extends through the bore 10 in the other handle piece.

DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figure 1:
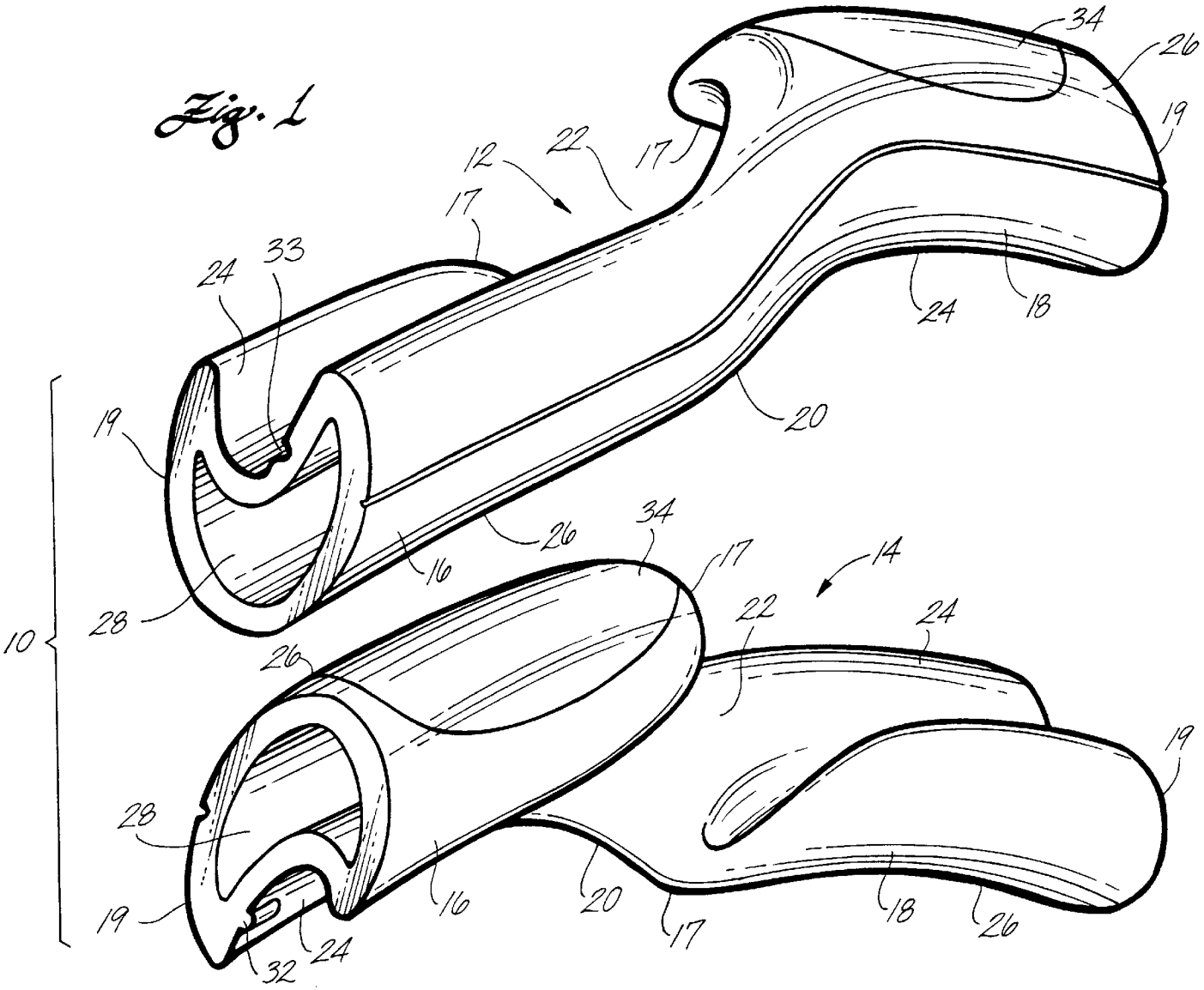
FIG. 1 is a three-quarter elevational view of handle pieces of a handle assembly according to one embodiment of the present invention where the handle pieces are not interconnected and have a "U" cross-sectional shape.
Figure 2:
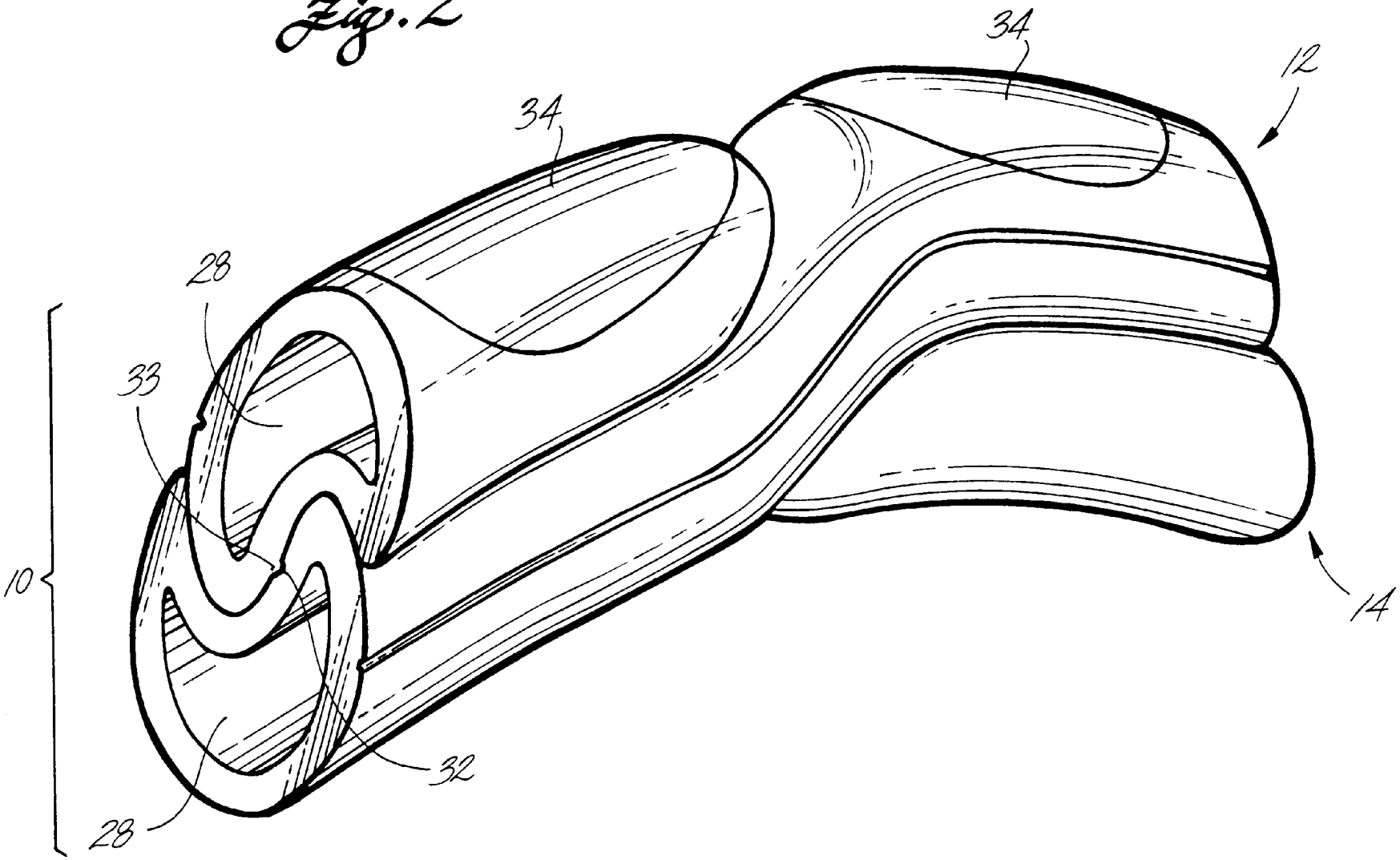
FIG. 2 is a three-quarter elevational view of a handle assembly according to the present invention where the handle pieces are interconnected and have a "U" cross-sectional shape.

As shown in FIGS. 1 and 2, the present invention is directed to a handle assembly 10 comprising two interlocking handle pieces 12, 14. In the illustrated embodiment, the handle pieces 12, 14 are identical in size and shape. This design allows both handle pieces 12, 14 to be cast from the same mold.

Each handle piece 12, 14 comprises a left section 16, a right section 18, and a center section 20. On each handle piece, the left section 16 and right section 18 each have an inside end 17 and an outside end 19. The center section 20 connects the inside end 17 of the left section 16 to inside end 17 of the right section 18 in a generally diagonal manner. On handle piece 12, the left section 16 is situated below the right section 18. On handle piece 14, the left section 16 is situated above the right section 18. The center section 20 contains a notch 22 for receiving the other handle piece, as described in more detail below.

The left section 16 and right section 18 each comprise an inside face 24 and an outside face 26. In practice, the handle pieces 12, 14 fit together such that the center section 20 of each handle piece fits into the notch 22 of the other handle piece, generally forming an "X". The handle pieces 12, 14 are rotated toward each other and snap together. When the handle pieces 12, 14 are snapped together, the inside face 24 of the left section 16 of handle piece 12 is situated against the inside face 24 of the left section 16 of handle piece 14. Similarly, the inside face 24 of the right section 18 of handle piece 12 is situated against the inside face 24 of the right section 18 of handle piece 14. This design keeps the handle pieces 12, 14, once interlocked, from becoming separated without action by the user.

Figure 3:
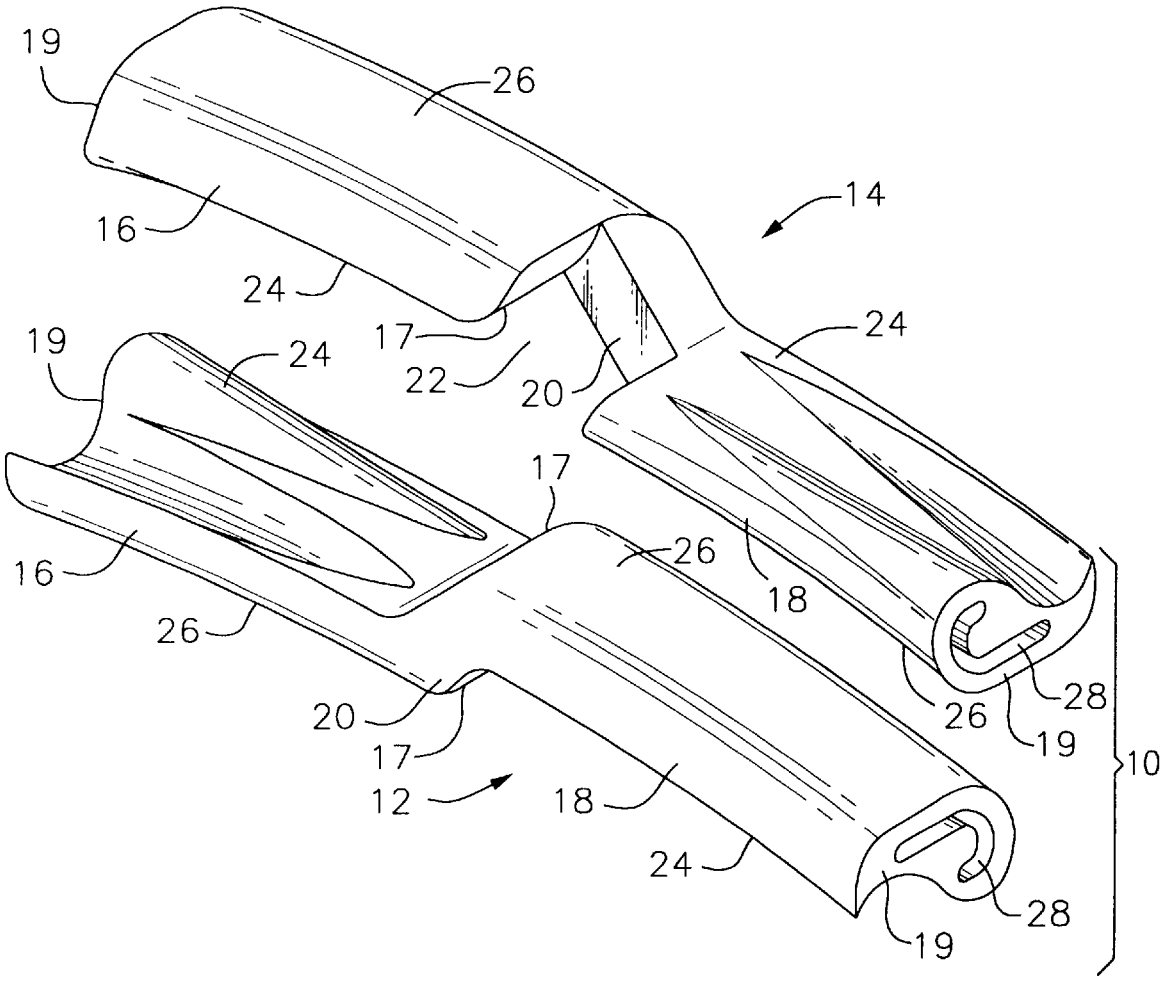
FIG. 3 is a three-quarter elevational view of handle pieces of an alternative embodiment of a handle assembly according to the invention where the handle pieces are not interconnected and have a yin and yang cross-sectional shape.
Figure 4:
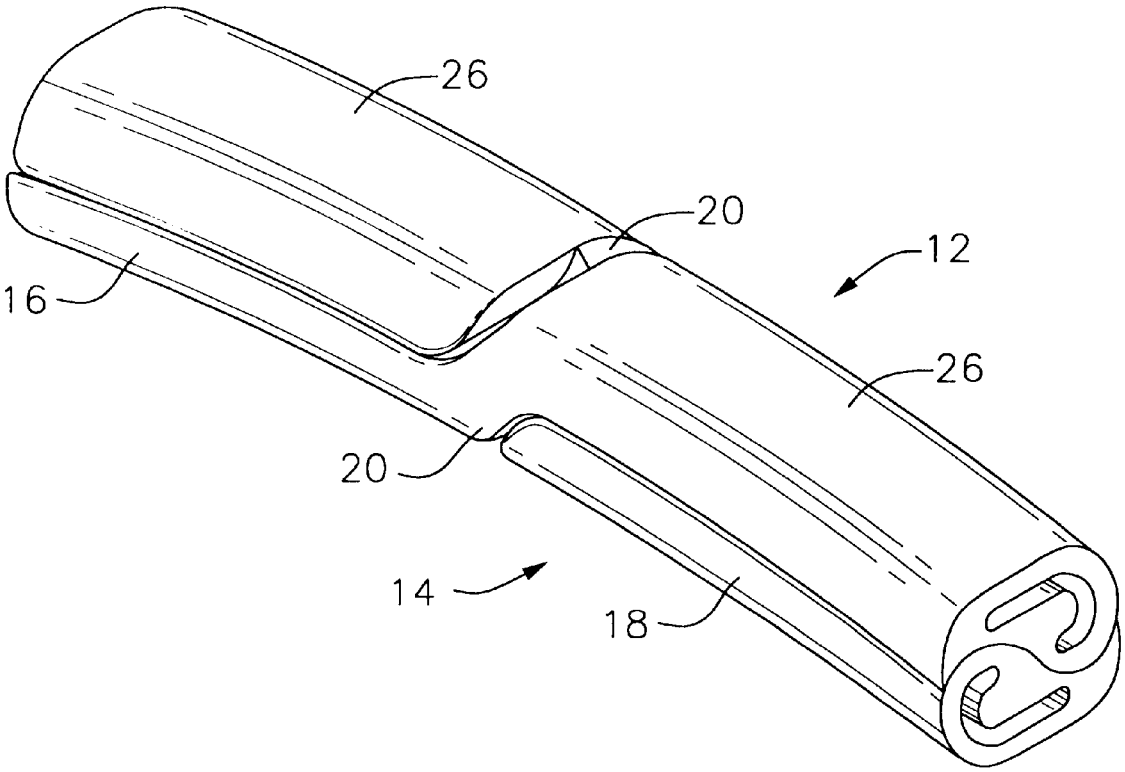
FIG. 4 is a three-quarter elevational view of handle pieces of an alternative embodiment of a handle assembly according to the invention where the handle pieces are interconnected and have a yin and yang cross-sectional shape.

The precise shape of the handle piece 12, 14 is not critical. For example, the handle pieces 12, 14 can each have an "S" shape as shown in FIG. 1, resulting in a rounded handle assembly 10, as shown in FIG. 2. Alternatively, if a flatter, straighter handle assembly 10 is desired, each handle piece 12, 14 can have a "lightening" cross-sectional shape, as shown in FIGS. 3 and 4. A rounded handle assembly 10 is generally preferred, as it is more comfortable for the user to grasp.

A nub 32 is provided on the inside face 24 of the left section 16 of handle piece 12, preferably at the outside end 19. A nub 32 is also provided on the inside face 24 of the right section 18 of handle piece 14, preferably at the outside end 19. Corresponding indentations 33 are located on the inside face 24 of the left section 16 of handle piece 14 and on the inside face 24 of the right section 18 of handle piece 12. The nubs 32 fit into the indentations 33, enhancing the ability of the handle pieces 12, 14 to snap together.

One or more inserts 34 are included on the top of one or both of the handle pieces 12, 14. The inserts 34 provide an economical means for imprinting or molding a logo or design into the handle pieces. The inserts 34, due to their soft texture, provide comfort to the user. If desired, additional inserts can be placed on the bottoms of the handle pieces for comfort. The inserts 34 can be made of any suitable material, for example, polyvinylchloride rubber, Kraton, natural rubber or polyurethane.

Figure 5:
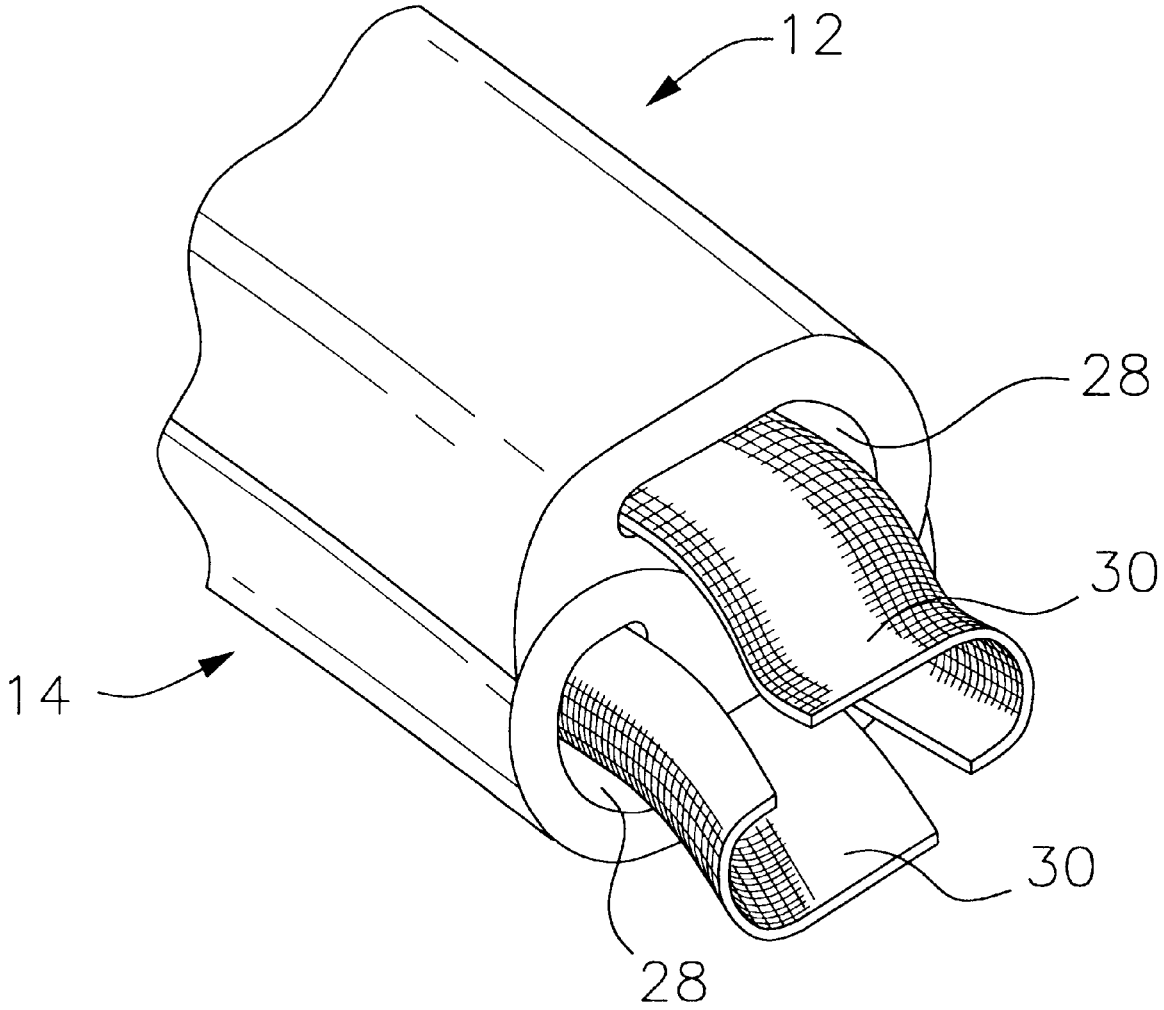
FIG. 5 is a partial end view of a handle assembly according to the present invention.

As shown in FIG. 5, each handle piece 12, 14 has a bore 28 to accommodate a handle strap 30 for use on a bag. The bore 28 extends through the entire length of each handle piece 12, 14. Each handle piece 12, 14 is associated with a handle strap 30. For example, each handle piece 12, 14 can be slidably attached to a handle strap 30. With this design, the handle pieces 12, 14 cannot be removed from the handle straps 30, but can freely slide along the length of the handle straps.

Alternatively, each handle piece 12, 14 can be fixedly attached to a handle strap 30, such that the handle piece 12, 14 is permanently situated on the handle strap 30 at a specific location. If the handle pieces 12, 14 are permanently attached to the handle straps 30, they are preferably located at the center of the handle straps. In a preferred embodiment, one handle piece is fixedly attached to one handle strap and the other handle piece is slidably attached to a second handle strap. This design allows for slight inaccuracies that can occur during manufacturing. Specifically, if both handle pieces are fixedly attached to the handle straps and are at slightly different locations along the handle straps, then one of the handle straps will not be taut when the handle pieces are interlocked. In contrast, if only one handle piece is fixedly attached to one handle strap while the other handle piece is free to slide on the other handle strap, the user can assure that the handle straps are properly aligned with one another. In a particularly preferred embodiment, neither handle strap is fixedly attached to its respective handle piece, but the handle strap size is such that it fits snuggle within the bole so that friction restrains the handle piece to some degree from sliding freely along the strap.

Preferably the cross-sectional shape of the handle assembly 10 when the handle pieces 12, 14 are interlocked is generally oval or round, but can also be square or rectangular, preferably with rounded corners. The rounded design reduces the risk to the user of pinching his or her hand in the handle assembly 10. Additionally, the rounded design provides more comfort to the user when gripping the handle assembly 10. The cross-section of each handle piece 12, 14 can be any suitable shape. A preferred cross-sectional shape for each handle piece is shown in FIG. 1 and is generally a "U" shape. This "U" shape prevents the handle pieces 12, 14 from twisting around the vertical axis once interlocked. This "U" shape also permits a handle strap 30 having a width greater than that of the handle pieces 12, 14 to fit into the handle pieces in a curved manner. Alternatively, the cross-section of each handle piece 30 12, 14 can have an "L" shape or a yin and yang shape.

The handle pieces 12, 14 can be made by injection molding and can be made of any suitable material. Preferably the handles are made of plastic, such as polycarbonate, polypropylene, nylon, polyvinyl chloride, acrylonitrile-butadiene-styrene (ABS), an ABS/polycarbonate blend, or high density polyethylene.

Finger depressions may be provided on each handle piece 12, 14. The finger depressions allow the user to more easily separate the handle pieces once interlocked. Alternatively, small nubs can be provided in place of the finger depressions. Such nubs are less desirable, however, because they may impair the comfort of the user when gripping the handle, i.e., dig into the user's hand.

The dimensions of the handle 10 are not critical and depend somewhat on the size of the bag being carried, including the size of the handle straps 30. Preferably the handle pieces each have a length (line A) ranging from about 8 cm to about 16 cm, more preferably from about 10 cm to about 14 cm, and still more preferably about 11.5 cm. Preferably the width (line B) of the handle pieces 12, 14 ranges from about 2 cm to about 4 cm, more preferably from about 2.5 cm to about 3.5 cm, and still more preferably about 2.8 cm. Preferably the handle 10, when the handle pieces 12, 14 are interlocked, has a depth (line C) ranging from about 2 cm to about 6 cm, more preferably from about 4 cm to about 5 cm, and still more preferably about 4.5 cm.

Each handle piece 12, 14 is preferably assembled from two half pieces. The half pieces can be fixedly attached by any suitable means, such as by screws, snap fit, sonic weld, glue, riveting, heat stake, or any combination thereof. The handle straps 30 are preferably assembled into the handle pieces 12, 14 at the time the half pieces are fixedly attached to one another, but can alternatively be inserted into the handle pieces after the half pieces are assembled. If the handle straps 30 are considerably wider than the bores 28 in the handle pieces 12, 14, the straps 30 can be folded over to fit into the bores. If it is desired to fixedly attach the handle straps to the handle pieces, this can be accomplished, for example, by extending the screws used to attach the half pieces through the webbing of the handle strap. Another means of fixedly attaching a handle piece to a handle strap is by situating one or more burrs on the inside of each handle piece. Each burr is preferably a relatively dull spike that will not tear the handle strap, and has a length, for example, of about 1 mm to about 3 mm.

The handle straps can be made of any suitable fabric, and are preferably made of polypropylene webbing. Other suitable materials include, but are not limited to, cotton and nylon. The handle straps can be attached to any suitable bag, such as a tote bag or sports bag.

The above description of preferred embodiments of the present invention are for illustrative purposes. Because of variations that will be apparent to those skilled in the art, the present invention is not intended to be limited to the particular embodiments described above. The scope of the invention is defined in the following claims.

I claim:

1. A handle assembly comprising two handle pieces, each handle piece comprising:

a left section having left and right ends and inside and outside faces, a right section having left and right ends and inside and outside faces, a center section containing a notch, said center section connecting the right end of the left section to the left end of the right section in a generally diagonal manner, wherein the handle pieces are capable of interlocking such that the center section of each handle piece fits into the notch of the other handle piece, the inside face of the left section of one handle piece is situated against the inside face of the left section of the other handle piece, and the inside face of the right section of one handle piece is situated against the inside face of the right section of the other handle piece.

2. A handle assembly according to claim 1 wherein the two handle pieces have the same size and shape.

3. A handle assembly according to claim 2 wherein the cross-sectional shape of each handle piece is a "U" shape.

4. A handle assembly according to claim 1 wherein each handle piece further comprises a bore for receiving a handle strap, wherein the bore extends through the left section, center section and right section of the handle piece.

5. A handle assembly according to claim 4 wherein the two handle pieces have the same size and shape.

6. A handle assembly according to claim 5 wherein the cross-sectional shape of each handle piece is a "U" shape.

7. A handle assembly according to claim 1 wherein the handle pieces are made of plastic.

8. A handle assembly according to claim 1 wherein each handle piece has a length ranging from about 8 cm to about 16 cm.

9. A handle assembly according to claim 8 wherein each handle piece has a length ranging from about 10 cm to about 14 cm.

10. A handle assembly according to claim 1 wherein each handle piece has a width ranging from about 2 cm to about 4 cm.

11. A handle assembly according to claim 10 wherein each handle piece has a width ranging from about 2.5 cm to about 3.5 cm.

12. A handle assembly according to claim 1 having a depth ranging from about 2 cm to about 6 cm.

13. A handle assembly according to claim 12 having a depth ranging from about 4 cm to about 5 cm.

14. A bag comprising two handle straps and a handle assembly, said handle assembly comprising two handle pieces, each handle piece comprising:

a left section having left and right ends and inside and outside faces, a right section having left and right ends and inside and outside faces, a center section containing a notch, said center section connecting the right end of the left section to the left end of the right section in a generally diagonal manner, wherein the handle pieces are capable of interlocking such that the center section of each handle piece fits into the notch of the other handle piece, the inside face of the left section of one handle piece is situated against the inside face of the left section of the other handle piece, and the inside face of the right section of one handle piece is situated against the inside face of the right section of the other handle piece; and wherein each handle strap is associated with a different handle piece.

15. A bag according to claim 14 wherein the two handle pieces have the same size and shape.

16. A bag according to claim 15 wherein the cross-sectional shape of each handle piece is a "U" shape.

17. A bag comprising two handle straps and a handle assembly, said handle assembly comprising two handle pieces, each handle piece comprising:

a left section having left and right ends and inside and outside faces, a right section having left and right ends and inside and outside faces, a center section containing a notch, said center section connecting the right end of the left section to the left end of the right section in a generally diagonal manner, and a bore extending through the left section, center section, and right section, wherein the handle pieces are capable of interlocking such that the center section of each handle piece fits into the notch of the other handle piece, the inside face of the left section of one handle piece is situated against the inside face of the left section of the other handle piece, and the inside face of the right section of one handle piece is situated against the inside face of the right section of the other handle piece, wherein one handle strap extends through the bore in one of the handle pieces and the other handle strap extends through the bore in the other handle piece; and wherein each handle strap is associated with a different handle piece.

18. A bag according to claim 17 wherein the two handle pieces have the same size and shape.

19. A bag according to claim 18 wherein the cross-sectional shape of each handle piece is a "U" shape.

* * * * *